US006807788B1

(12) United States Patent
Terry

(10) Patent No.: US 6,807,788 B1
(45) Date of Patent: Oct. 26, 2004

(54) BALUSTER KIT

(76) Inventor: Edgell R. Terry, 1115 Shady La., Rome City, IN (US) 46784

( * ) Notice: Subject to any disclaimer, the term of this patent is extended or adjusted under 35 U.S.C. 154(b) by 0 days.

(21) Appl. No.: 10/618,555

(22) Filed: Jul. 14, 2003

(51) Int. Cl.[7] ..... E04C 3/30
(52) U.S. Cl. ..... 52/720.2; 52/736.4; 256/65.01
(58) Field of Search ..... 52/720.2, 736.4, 52/736.1, 736.2, 730.7; 256/65.01, 65.14, 59; 144/3.1, 353, 354

(56) References Cited

U.S. PATENT DOCUMENTS

| | | | | | |
|---|---|---|---|---|---|
| 3,788,608 | A | | 1/1974 | Raymond et al. | |
| 4,403,767 | A | * | 9/1983 | Basey | 256/66 |
| 4,655,017 | A | | 4/1987 | Bond | |
| 4,722,374 | A | | 2/1988 | Bond | |
| 4,886,245 | A | * | 12/1989 | Manzo | 256/67 |
| 5,136,770 | A | | 8/1992 | Kenngott | |
| 5,149,060 | A | * | 9/1992 | Boes | 256/21 |
| D342,437 | S | | 12/1993 | Prezner | |
| 5,613,664 | A | * | 3/1997 | Svalbe | 256/19 |
| 5,876,021 | A | * | 3/1999 | Spence et al. | 256/19 |
| 6,098,552 | A | | 8/2000 | Gunderson | |
| D471,650 | S | * | 3/2003 | Dani | D25/126 |

* cited by examiner

*Primary Examiner*—Naoko Slack
(74) *Attorney, Agent, or Firm*—Donald R. Schoonover

(57) ABSTRACT

A baluster includes a proximal section that is mounted on a stair of a staircase and a distal section that is fastened to a railing associated with the staircase. The distal section includes a bore which snugly and releasably accommodates a central section of the baluster so the central section can be moved with respect to the distal section whereby the baluster can be easily accommodated between the stair and the railing.

2 Claims, 2 Drawing Sheets

BALUSTER KIT

BACKGROUND OF THE INVENTION

1. Field of the Invention

The present invention relates to the general art of static structures, and to the particular field of railings associated with staircases in buildings.

2. Discussion of the Related Art

Many buildings contain some sort of staircase, balcony or terrace. These elements often have a railing associated therewith. The railings are generally supported on the surface of the staircase by balusters, and the balusters are often shaped to be aesthetically pleasing. Furthermore, the staircase may be carpeted or have stairs that are formed of fine, and expensive, material.

Often, the railing is mounted on the stairs of the staircase by mounting one baluster after another. After the first baluster is in place, and particularly in placing the final balusters, it may be difficult and/or time consuming to place and position balusters between the railing and the top surface of the stair or stairs associated with these later-placed balusters.

In some cases, the placement of such late balusters may cause damage to either the carpeting or the top surface of the stairs. This consideration may exacerbate the difficulty and time-consuming problems mentioned above.

Therefore, there is a need for a baluster which can be easily and quickly placed between a stair and a railing associated with that stair.

Furthermore, there is a need for a baluster which can be easily and quickly placed between a stair and a railing associated with that stair without damaging carpeting on the surface of the stair.

Still further, many people who install railings are not highly skilled carpenters and thus the above-mentioned problems become even more difficult for such people.

Therefore, there is a need for a baluster which can be easily and quickly placed between a stair and a railing associated with that stair and which can be easily installed by someone who is not a highly skilled carpenter. The do-it-yourself market is hampered since installation of many presently-available balusters requires special tools.

Therefore, there is a need for a baluster which can be easily and quickly placed and/or replaced without the need of expensive or special tools.

There are some times when it is necessary to remove a railing or remove one or more balusters to service the stairs or the railing. However, presently available balusters make this job difficult.

Therefore, there is a need for a baluster which can be easily and quickly removed and replaced.

OBJECTS OF THE INVENTION

It is a main object of the present invention to provide a baluster which can be easily and quickly placed between a stair and a railing associated with that stair.

It is another object of the present invention to provide a baluster which can be easily and quickly placed between a stair and a railing associated with that stair without damaging carpeting on the surface of the stair.

It is another object of the present invention to provide a baluster which can be easily and quickly placed between a stair and a railing associated with that stair and which can be easily installed by someone who is not a highly skilled carpenter.

It is another object of the present invention to provide a baluster which can be easily and quickly removed and replaced.

It is another object of the present invention to provide a baluster which can be easily and quickly placed and/or replaced without the need of expensive or special tools.

SUMMARY OF THE INVENTION

These, and other, objects are achieved by a baluster which comprises a base section adapted to be mounted on a stair and having a fastener element thereon, the fastener element fastening the base section to the stair when the base section is mounted on the stair; a central section connected to the base section; and a distal section adapted to be mounted on the central section and having a connecting element adapted to be connected to a rail associated with the stair, and a bore sized to snugly and releasably accommodate one end of the central section when the distal section is mounted on the central section.

The bore permits the central section of the baluster to be easily and quickly moved with respect to the rail and the stair so the baluster can be easily and quickly adjusted to properly fit the space between the rail and the stair. The base section can be easily installed at the most opportune time, i.e., either before or after a finished top surface of the stair is provided.

Thus, the baluster embodying the present intention can be quickly and easily installed by someone who is not highly skilled and can be installed without damaging the stair or any covering on the stair. Because the baluster of the present invention is a two piece unit, it can be easily removed once it is in place. Thus, the baluster, the stairs, or the railing can be easily and quickly serviced. Expensive and unique tools are not required to place balusters thereby making the job less expensive than existing baluster placement jobs. Carpeting, or other floor covering can be placed whenever it is most convenient to complete the floor covering job, and the floor covering job need not be coordinated with the placement of balusters.

It is noted that the disclosure refers to a stair and a railing; however, those skilled in the art will understand that the baluster of the present invention can be used in connection with terraces or balconies as well without departing from the scope of the present disclosure.

BRIEF DESCRIPTION OF THE DRAWING FIGURES

DETAILED DESCRIPTION OF THE PREFERRED EMBODIMENT

Figure 3:
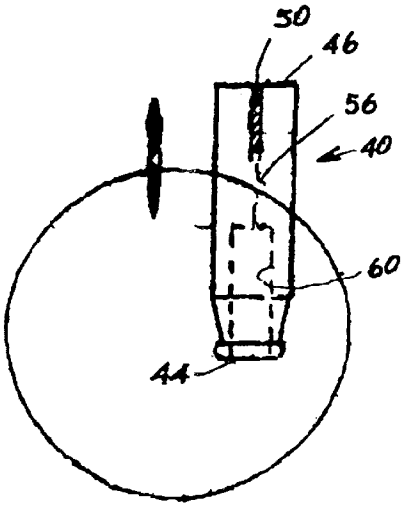
FIG. 3 shows the detail indicated by "A" in FIG. 2.
Figure 2:
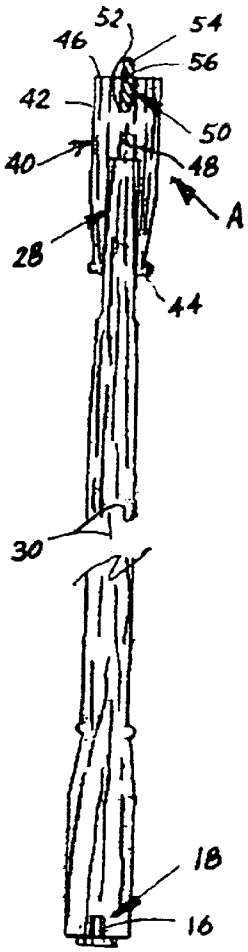
FIG. 2 is a view taken along line 2—2 of FIG. 1.
Figure 1:
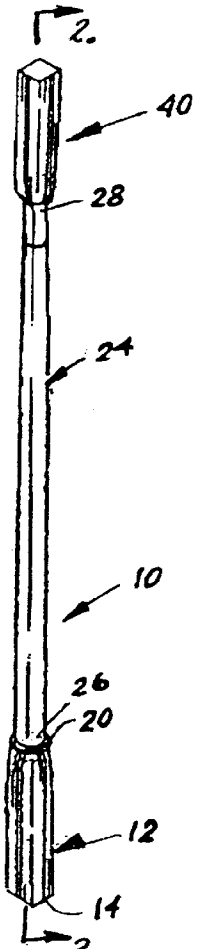
FIG. 1 is a perspective view of a baluster embodying the present invention.

Other objects, features and advantages of the invention will become apparent from a consideration of the following detailed description and the accompanying drawings.

Referring to the Figures, it can be understood that the present invention is embodied in a baluster kit 10 which is used to support a railing R above stairs S of a staircase SC.

Baluster 10 comprises a base section 12 which has a proximal end 14 adapted to be mounted on an upper surface US of a stair. A fastener-accommodating hole 16 is defined in the base section 12 through the proximal end 14 thereof. A fastener 18 is adapted to be accommodated in the fastener-accommodating hole 16 and which is adapted to fasten the base element 12 to the stair when the base section 12 is mounted on the stair. The base section 12 also has a distal end 20.

The baluster 10 further comprises a central section 24 which has a first end 26 connected to the distal end 20 of the base section 12 and a second end 28. The central section 24 further includes a longitudinal axis 30 which extends between the first end 26 of the central section 24 and the second end 28 of the central section 24.

A distal section 40 is adapted to be mounted on the central section 24. Distal section 40 includes a body 42 which has a first end 44, a second end 46, and a longitudinal axis 48 which extends between first end 44 and second end 46 of the body 42. The longitudinal axis 48 of the body 42 is collinear with the longitudinal axis 30 of the central section 24 when the distal section 40 is mounted on the central section 24.

A connecting element 50 has a proximal end 52 fixed to the body 42 of the distal section 40 at the second end 46 of the distal section 40, and a distal end 54 spaced apart from the second end 46 of the body 42 of the distal section 40. The connecting element 50 has a longitudinal axis 56 which extends between the proximal end 52 of the connecting element 50 and the distal end 54 of the connecting element 50. The longitudinal axis 56 of the connecting element 50 is collinear with the longitudinal axis 48 of the body 42 of the distal section 40 when the distal section 40 is in place on the central section 24. The connecting element 50 is adapted to be connected to a rail associated with the stair and to be located above the stair to connect the distal section 40 to the rail R.

A bore 60 is defined in the body 42 of the distal section 40 and extends along the longitudinal axis 48 of the body 42 of the distal section 40 from the first end 44 of the body 42 of the distal section 40 toward the second end 46 of the body 42 of the distal section 40. The bore 60 is sized to snugly and releasably accommodate the central section 24 adjacent to the second end 28 of the central section 24 when the distal section 40 is mounted on the central section 24.

Figure 4:
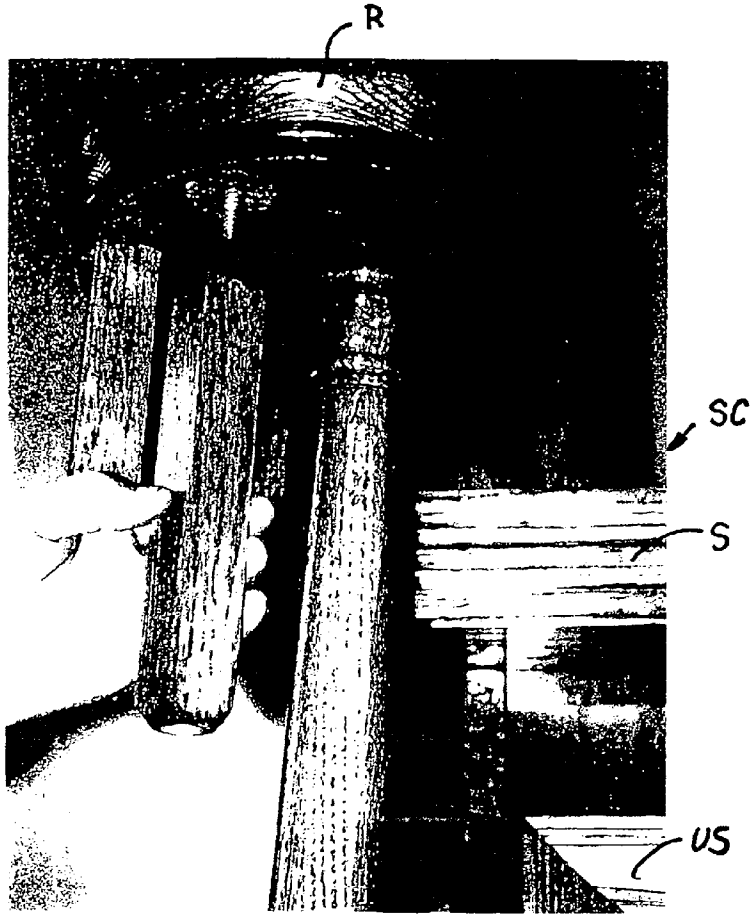
FIG. 4 shows a distal section of the baluster of the present invention fixed to a rail associated with a staircase.

The central section 24 and the base section 12 are of one-piece construction and the distal section 40 is separate. Thus, as indicated in FIG. 4, the base 12 and the central section 24 can be installed on a stair and then slipped into the bore 60 of the distal section 40 to assemble the baluster 10.

Figure 5:
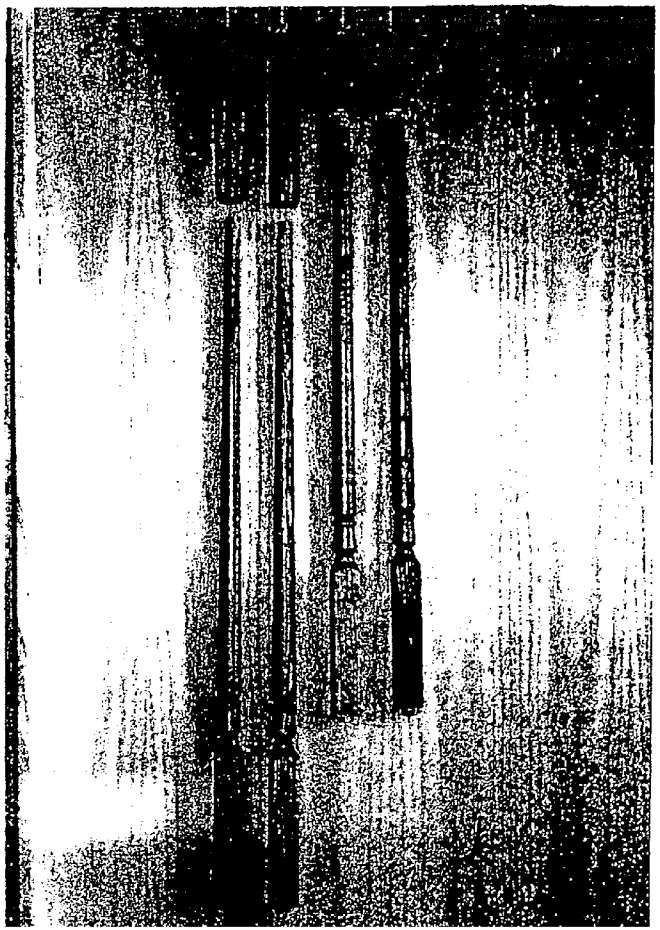
FIG. 5 shows balusters of various lengths which fall within the scope of the present disclosure.

The central section 24 can be made in any suitable shape, out of any suitable material and can be any of a variety of lengths as indicated in FIG. 5. Thus, the baluster 10 embodying the present invention can be used in connection with a wide variety of elements.

It is understood that while certain forms of the present invention have been illustrated and described herein, it is not to be limited to the specific forms or arrangements of parts described and shown.

What is claimed is:

1. A baluster kit comprising:

a) a base section having (1) a proximal end adapted to be mounted on an upper surface of a stair, (2) a fastener-accommodating hole defined in said base element through the proximal end of said base element, (3) a fastener adapted to be accommodated in the fastener-accommodating hole and which is adapted to fasten said base to the stair when said base section is mounted on the stair, and (4) a distal end;

b) a central section having a first end connected to the distal end of said base section and a second end, the central section further including a longitudinal axis extending between the first end of said central section and the second end of said central section; and c) a distal section adapted to be mounted on said central section and including (1) a body having a first end, a second end, and a longitudinal axis extending between the first end of the body and the second end of the body, the longitudinal axis of the body being collinear with the longitudinal axis of said central section when said distal section is mounted on said central section, (2) a connecting element having a proximal end fixed to the body of said distal section at the second end of said distal section, and a distal end spaced apart from the second end of the body of said distal section, the connecting element having a longitudinal axis extending between the proximal end of the connecting element and the distal end of the connecting element, the longitudinal axis of the connecting element being collinear with the longitudinal axis of the body of said distal section when said distal section is in place on said central section, the connecting element being adapted to be connected to a rail associated with the stair and located above the stair to connect said distal section to the rail, and (3) a bore defined in the body of said distal section and extending along the longitudinal axis of the body of said distal section from the first end of the body of said distal section toward the second end of the body of said distal section, the bore being sized to snugly and releasably accommodate said central section adjacent to the second end of said central section when said distal section is mounted on said central section.

2. The baluster as described in claim 1 wherein said base section and said central section are of one-piece construction.

* * * * *